US005411582A

United States Patent [19]

Bodine

[11] Patent Number: 5,411,582

[45] Date of Patent: May 2, 1995

[54] PROCESS FOR THE ELECTROPHORETIC DEPOSITION OF METAL POWDER FOR THE RECOATING OF A PART BY DIFFUSION BRAZING, AND ELECTROPHORESIS BATH FOR USE THEREIN

[75] Inventor: Marie-Josephe A. Bodine, Chattellerault, France

[73] Assignee: Societe Sochata, Velizy Villacoublay, France

[21] Appl. No.: 222,713

[22] Filed: Apr. 4, 1994

Related U.S. Application Data

[62] Division of Ser. No. 957,166, Oct. 7, 1992, Pat. No. 5,336,382.

[30] Foreign Application Priority Data

Oct. 9, 1991 [FR] France ..... 91 12409

[51] Int. Cl.[6] ..... C25D 13/00

[52] U.S. Cl. ..... 106/1.05; 204/181.4; 106/1.21

[58] Field of Search ..... 204/181.4, 181.6, 181.7; 106/1.05, 1.21

[56] References Cited

U.S. PATENT DOCUMENTS 4,476,261 10/1984 Patzschke et al. ..... 523/402
4,792,357 12/1988 Bier ..... 524/413

*Primary Examiner*—John Niebling
*Assistant Examiner*—Kishor Mayekar
*Attorney, Agent, or Firm*—Oblon, Spivak, McClelland, Maier, & Neustadt

[57] ABSTRACT

Metal powder for recoating a superalloy part by a diffusion brazing heat treatment is deposited on the part by electrophoresis in a bath comprising an aqueous solution of from 7.5 to 17.5 g/1 of a natural gum based binder and, in dispersion in the solution, from 1.75 to 2.25 kg/1 of a known mixture of two metal powders suitable for the recoating.

1 Claim, No Drawings

PROCESS FOR THE ELECTROPHORETIC DEPOSITION OF METAL POWDER FOR THE RECOATING OF A PART BY DIFFUSION BRAZING, AND ELECTROPHORESIS BATH FOR USE THEREIN

This is a division of application Ser. No. 07/957,166, filed on Oct. 7, 1992, now U.S. Pat. No. 5,336,382.

BACKGROUND OF THE INVENTION

1. Field of the Invention

The invention relates to a process for the electrophoretic deposition of metal powders capable of producing thick deposits suitable for recoating parts, particularly nickel-based superalloy parts intended for aeronautical applications or turbomachines, using diffusion brazing techniques. The invention relates also to the composition of the electrophoresis bath which is used in the process and from which the metal powders are deposited.

2. Summary of the Prior Art

It is known to carry out, both in repair work and in the manufacture of new parts, recoating of parts using diffusion brazing techniques, the coating material taking a variety of forms but particularly a mixture of metal powders which, for example, may be put in place in paste form by injection using a syringe. Examples of these techniques are described in EP-A-75497 and EP-A-165104.

It is also known from GB-A-1466204 to provide an anti-corrosion coating on a superalloy part by electrophoretic deposition of a mixture of aluminium powder and a powder of a chromium-aluminium alloy from a suspension of these powders in an organic dielectric based on isopropyl alcohol, nitromethane and zein, and a diffusion heat treatment.

FR-A-2308704 further describes a process for coating a metal surface by electrophoresis using an aqueous dispersion of aluminium powder and a theromsetting acrylic resin.

SUMMARY OF THE INVENTION

The aim of the invention is to provide, compared with the known method described earlier, an improved method of placing in position the material for recoating a part using a known diffusion brazing technique.

To this end, according to the invention there is provided a process for the electrophoretic deposition of metal powder for the recoating of superalloy parts by a diffusion brazing heat treatment, comprising the steps of:

providing an electrophoresis bath comprising an aqueous solution of from 7.5 to 17.5 grams per liter of a natural gum based binder called agar-agar, and containing from 1.75 to 2.25 kg per liter of metal particles obtained from a mixture of two powders of known composition suitable for the said recoating;

placing the part to be recoated in said bath at the anode position;

carrying out electrophoresis in said bath observing the following parameters:

- an inter-electrode of from 10 to 80 mm,
- a continuous electric field of from 5 to 30 V/cm,
- a current density of from 0.2 to 2 A/dm$^2$, and
- a temperature close to 20° C., to obtain a deposit of said metal particles on said part having a thickness between 0.1 and 2 mm;

and subsequently air drying said part.

Other features and advantages of the invention will become apparent from the following description of the preferred embodiments.

DESCRIPTION OF THE PREFERRED EMBODIMENTS

The electrophoresis bath is prepared by making an aqueous solution using demineralized water and from 7.5 to 17.5 grams per liter of a natural gum-based binding agent, agar-agar, having a gelling temperature of 85° C. The aqueous solution obtained is a mucilage remarkable for its high viscosity, its role being to:

- ensure a homogeneous suspension of the metal particles in a highly viscous medium,
- permit the transport of metal particles under the action of an electrophoretic field, and
- ensure an adequate mechanical resistance of the raw deposition.

The aqueous solution is then charged with a dispersion of metal particles derived from a mixture of two powders, the mixture being known per se for the recoating of parts by means of a diffusion brazing heat treatment. For example, in recoating of aircraft or turbomachine parts made of nickel-based alloys, the mixture used has a density of 8.35 and the grain size of the powders is below 53 μm. From 1.75 to 2.25 kg per liter of the metal powder is introduced into the aqueous solution to form the electrophoretic bath. The pH of the solution is between 4.5 and 6 and the solution has a non-Newtonian character, its viscosity varying depending on certain physical parameters such as temperature and the mechanical stirring of the bath.

By way of example, an electrophoretic deposition in accordance with the invention was carried out on a substrate having an 8 cm$^2$ plane surface, using a bath as described above. The substrate was placed at the anode, and a cathode of non-oxidizing alloy and having a grid profile was used. The distance between the electrodes was between 10 and 80 mm. A continuous electric field of between 5 and 30 V/cm was applied, and the current density was from 0.2 to 2 A/dm$^2$. Deposition was carried out ambient temperature, i.e. approximately 20° C. There was no stirring of the bath during deposition.

Deposit thicknesses ranging between 0.1 and 2 mm may be obtained as a function of deposition time and the operating parameters selected.

The following results were obtained:

- deposit thickness in μm: 100; 800; 1500
- electric field in V/cm: 3.3; 10; 16.7
- time in seconds: 5; 30; 45

The deposits obtained are perfectly uniform and adherent, the composition being that of the metal powder in the electrophoretic bath. The crude electrophoretic deposit is hydrated in a proportion of 20 to 40%, and the water is eliminated by an air drying treatment, for example for 24 hours at ambient temperature or for 2 hours at 120° C.

After drying, the mechanical strength of the deposit is sufficient to permit handling of the part and the carrying out of a diffusion brazing heat treatment which consolidates the deposit to obtain the recoating possessing the desired mechanical and metallurgical characteristics.

The operational conditions and parameters of the heat treatment are known and established for each application as a function of the particular material of the part to be recoated, and the coating material selected.

After consolidation of the deposit by the diffusion brazing heat treatment the micrographic structure of the deposit is found to be identical to that of the deposits previously obtained when the placement of the coating material before the heat treatment is effected in a known manner, such as in the form of a paste containing the mixture of metal powders using a syringe.

The process for the electrophoretic deposition of metal powders for the recoating of parts by a diffusion brazing heat treatment may be used for a recoating operation when repairing parts and/or during the manufacture of new parts.

When certain areas of a part are not to be coated, these areas are masked in a known manner. Outer areas may be masked by using a suitable adhesive masking tape, and for inner cavities silicone plugs may be used.

In cases where the part has to be coated on both sides, when the electrophoretic deposition is carried out, the part is placed between two shaping electrodes situated at an equal distance, according to the criteria previously defined.

I claim:

1. A bath for electrophoretically depositing metal powder upon a superalloy part to obtain a deposit suitable for producing a coating of the superalloy part by a diffusion brazing heat treatment, comprising demineralized water, from 7.5 to 17.5 grams per liter of agar-agar in solution in said water, and from 1.75 to 2.25 kg per liter of metal powder dispersed in said solution, wherein said metal powder is a diffusion brazing heat treatment mixture of two metals.

* * * * *

UNITED STATES PATENT AND TRADEMARK OFFICE

CERTIFICATE OF CORRECTION

PATENT NO. : 5,411,582

DATED : May 2, 1995

INVENTOR(S) : Marie-Josephe A. BODIN

It is certified that error appears in the above-indentified patent and that said Letters Patent is hereby corrected as shown below:

On the title page, Items [19] and [75], the inventor's last name is spelled incorrectly. It should read:

[19] --Bodin--

[75] --Marie-Josephe A. Bodin--

Signed and Sealed this

Eighteenth Day of July, 1995

Bruce Lehman

*Attest:*

BRUCE LEHMAN

*Attesting Officer*

*Commissioner of Patents and Trademarks*